US011798730B2

(12) United States Patent
Miyake

(10) Patent No.: US 11,798,730 B2
(45) Date of Patent: Oct. 24, 2023

(54) INDUCTOR COMPONENT AND METHOD FOR MANUFACTURING INDUCTOR COMPONENT

(71) Applicant: Murata Manufacturing Co., Ltd., Kyoto-fu (JP)

(72) Inventor: Isamu Miyake, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 435 days.

(21) Appl. No.: 17/021,890

(22) Filed: Sep. 15, 2020

(65) Prior Publication Data

US 2021/0104357 A1 Apr. 8, 2021

(30) Foreign Application Priority Data

Oct. 8, 2019 (JP) ..... 2019-185165

(51) Int. Cl.
*H01F 27/26* (2006.01)
*H01F 27/28* (2006.01)

(52) U.S. Cl.
CPC ..... *H01F 27/2828* (2013.01); *H01F 27/263* (2013.01)

(58) Field of Classification Search
CPC ..... H01F 17/0013; H01F 27/2804; H01F 2027/2809; H01F 27/24; H01F 27/292; H01F 27/32; H01F 17/0006; H01F 17/04; H01F 2017/0066; H01F 2017/048; H01F 27/323; H01F 41/046; H01F 2017/004;
(Continued)

(56) References Cited

U.S. PATENT DOCUMENTS

RE15,030 E * 1/1921 Steinberger et al. . H01F 41/041 336/205
3,973,321 A * 8/1976 Horton ..... H01F 17/04 336/83

(Continued)

FOREIGN PATENT DOCUMENTS

JP H02-60934 A 3/1990
JP 2016006830 A 1/2016

(Continued)

OTHER PUBLICATIONS

An Office Action mailed by China National Intellectual Property Administration dated Feb. 21, 2022, which corresponds to Chinese Patent Application No. 202011016284.5 and is related to U.S. Appl. No. 17/021,890 with English language translation.

*Primary Examiner* — Marlon T Fletcher
*Assistant Examiner* — Matthew T Sarles
(74) *Attorney, Agent, or Firm* — Studebaker & Brackett PC

(57) ABSTRACT

In an inductor component, an inductor wiring is provided inside an element body. The inductor wiring includes a wiring main body and a skirt portion adjacent to the wiring main body in a height direction of the inductor wiring. A dimension in a height direction in the wiring main body is larger than a dimension in the height direction in the skirt portion. A dimension of the skirt portion in a width direction in the inductor wiring increases as a distance from the wiring main body in the height direction increases. A dimension in the width direction of a distal end of the skirt portion is larger than a dimension in the width direction of the wiring main body.

18 Claims, 7 Drawing Sheets

(58) Field of Classification Search
CPC ..... H01F 2017/0073; H01F 27/29; H01F 27/324; H01F 41/041; H01F 41/12; H01F 1/26; H01F 1/28; H01F 17/00; H01F 17/0033; H01F 2017/0093; H01F 27/263; H01F 27/28; H01F 27/2828; H01F 27/306; H01F 41/00; H01F 41/043; H01F 27/366; H01F 5/003; H01F 38/14; H01F 41/04
See application file for complete search history.

(56) References Cited

U.S. PATENT DOCUMENTS 4,728,390 A * 3/1988 Yamamoto ..... H01F 5/003 216/48
5,493,263 A * 2/1996 Tozawa ..... H05K 1/0265 333/246
6,016,087 A * 1/2000 Sasaki ..... H05K 1/0242 29/829
6,111,204 A * 8/2000 Goenka ..... H05K 1/111 174/250
6,600,404 B1 * 7/2003 Kajino ..... H01F 5/003 336/200
11,145,452 B2 * 10/2021 Kim ..... H01F 17/0013
11,205,538 B2 * 12/2021 Moon ..... H01F 41/122
11,398,340 B2 * 7/2022 Kim ..... H01F 27/327
2009/0029185 A1 * 1/2009 Lee ..... H01F 17/0006 430/318
2013/0075860 A1 * 3/2013 Kuo ..... H01F 17/0033 257/E21.022
2013/0113594 A1 * 5/2013 Lee ..... H01F 41/041 336/200
2013/0241684 A1 * 9/2013 Yang ..... H01F 5/003 336/200
2013/0243940 A1 * 9/2013 Kamath ..... H01L 27/1292 343/866
2013/0300529 A1 * 11/2013 Chang ..... H01F 27/292 336/200
2017/0287621 A1 * 10/2017 Seino ..... H01F 1/26
2019/0013133 A1 * 1/2019 Sasaki ..... H01F 17/0013
2019/0122811 A1 * 4/2019 Jung ..... H01F 17/0013
2019/0244743 A1 * 8/2019 Hirai ..... H01F 41/12
2019/0246496 A1 * 8/2019 Wu ..... H05K 3/4644
2020/0027646 A1 * 1/2020 Hamada ..... H01F 27/323
2020/0051728 A1 * 2/2020 Matsumoto ..... H01F 17/0013
2020/0164597 A1 * 5/2020 Israelsson ..... H01F 5/00
2021/0036095 A1 * 2/2021 Pulugurtha ..... H01F 27/245
2021/0104345 A1 * 4/2021 Miyake ..... H01F 17/0006
2021/0104357 A1 * 4/2021 Miyake ..... H01F 27/2828
2021/0144847 A1 * 5/2021 Tsuchida ..... C23C 18/32
2021/0249171 A1 * 8/2021 Okumura ..... H01F 41/041

FOREIGN PATENT DOCUMENTS

JP 2017-098544 A 6/2017
JP 2017-183663 A 10/2017
JP 2019-016726 A 1/2019
JP 2019-114606 A 7/2019
JP 2019-134141 A 8/2019
WO 2013/021750 A1 2/2013
WO 2019/163292 A1 8/2019
WO WO-2019163292 A1 * 8/2019
WO WO-2019176152 A1 * 9/2019 ..... H01F 17/0006

* cited by examiner

| | X0 (μm) | X1 (μm) | X2 (μm) | Y (μm) | Z | DEVIATION OCCURRENCE RATE R (%) |
|---|---|---|---|---|---|---|
| COMPARATIVE EXAMPLE 1 | 63 | 60 | – | 55 | 0.92 | 20.1 |
| EXAMPLE 1 | 63 | 64 | 61 | 55 | 0.86 | 0.0 |
| EXAMPLE 2 | 63 | 62 | 61 | 55 | 0.89 | 0.8 |
| EXAMPLE 3 | 63 | 64 | 61 | 55 | 0.86 | 0.3 |

INDUCTOR COMPONENT AND METHOD FOR MANUFACTURING INDUCTOR COMPONENT

CROSS-REFERENCE TO RELATED APPLICATION

This application claims benefit of priority to Japanese Patent Application No. 2019-185165, filed Oct. 8, 2019, the entire content of which is incorporated herein by reference.

BACKGROUND

Technical Field

The present disclosure relates to an inductor component and a method for manufacturing an inductor component.

Background Art

Japanese Unexamined Patent Application Publication No. 2016-6830 describes an example of an inductor component in which a wiring is provided inside an element body having magnetism.

In the inductor component in which the wiring is provided inside the element body as described above, a position of the wiring may deviate from a design position in some cases. The design position refers to the position of the wiring defined by the design. When the position of the wiring is deviated from the set position inside the element body as described above, performance of the inductor component may change. Therefore, it is required to suppress a deviation between the position of the wiring and the design position.

SUMMARY

Accordingly, an inductor component includes an element body having magnetism, and an inductor wiring provided along a first plane inside the element body. A direction orthogonal to the first plane is defined as a height direction of the inductor wiring, and a direction orthogonal to both the direction in which the inductor wiring extends and the height direction among directions along the first plane is defined as a width direction of the inductor wiring. In this case, the inductor wiring has a wiring main body and a skirt portion adjacent to the wiring main body in the height direction. The dimension in the height direction of the wiring main body is larger than a dimension in the height direction of the skirt portion, and the dimension of the skirt portion in the width direction increases as a distance from the wiring main body in the height direction increases. In a case where an end of the skirt portion on the wiring main body side in the height direction is a proximal end and an end of the skirt portion on a side opposite to the wiring main body in the height direction is a distal end, a dimension of the distal end of the skirt portion in the width direction is larger than a dimension of the wiring main body in the width direction.

In a case where a portion adjacent to the inductor wiring expands or contracts, a displacement force, which is a force for displacing the inductor wiring in the width direction, may act on the inductor wiring in some cases. Such a displacement force increases as a dimension of the inductor wiring in the height direction is larger. In a case where a portion with which one end of the inductor wiring in the height direction is in surface contact is defined as a contacting portion, when a close contact force between the one end in the height direction of the inductor wiring and the contacting portion is small, a position of the inductor wiring in the width direction may change due to the displacement force.

Here, the close contact force between the contacting portion with which one end of the inductor wiring in the height direction is in surface contact and one end in the height direction of the inductor wiring increases as a dimension in the width direction of one end of the inductor wiring in the height direction is larger.

Therefore, in the above configuration, the inductor wiring includes a wiring main body and a skirt portion. A proximal end of the skirt portion is connected to the wiring main body. A dimension of the distal end of the skirt portion in the width direction is larger than a dimension in the width direction in the wiring main body. Therefore, the dimension in the width direction at one end of the inductor wiring in the height direction is larger than in a case where the inductor wiring does not include the skirt portion. As a result, the close contact force between one end of the inductor wiring in the height direction and the contacting portion increases. Accordingly, even when the displacement force as described above acts on the inductor wiring, it is possible to suppress displacement of the inductor wiring in the width direction due to the displacement force by an amount corresponding to an increase in the close contact force.

Also, the present disclosure provides a method for manufacturing an inductor component in which an inductor wiring is provided inside an element body having magnetism. This manufacturing method includes a resin layer forming process of forming a resin layer on a substrate; a seed film forming process of forming a seed film on the resin layer; a pattern forming process of forming a wiring pattern in which a shape of the inductor wiring in the inductor component is opened by patterning a protective film on the seed film; an energy lowering process of lowering a surface energy of the seed film; and a conductive layer forming process of, in a case where a portion of the seed film that is not covered with the protective film is defined as a seed layer, forming a conductive layer by supplying a conductive material to the wiring pattern to form the inductor wiring by the conductive layer and the seed layer. The method further includes a protective film removing process of removing the protective film; and an element body forming process of removing at least the substrate of the substrate and the resin layer, and forming the element body inside which the inductor wiring is provided.

According to the above-described configuration, the inductor wiring is formed by performing the conductive layer forming process. When the protective film is removed by the protective film removing process, the inductor wiring may receive the displacement force from the protective film. At this time, when a close contact force between the inductor wiring and the resin layer is small, there is a possibility that the inductor wiring is displaced in the width direction.

In the above configuration, the surface energy of the seed film is lowered by the energy lowering process. Then, a close contact property between the seed film and the protective film decreases, and therefore, a portion of the protective film that partitions the wiring pattern peels off from the seed film. In this state, the conductive material is supplied to the wiring pattern by the conductive layer forming process. At this time, the conductive material also flows into a gap between the seed film and the protective film that is peeled off from the seed film. As a result, the inductor wiring including the wiring main body and the skirt portion adjacent to the wiring main body in the height direction is formed. This makes it possible to increase the dimension in the width direction of the surface of the inductor wiring that is in contact with the resin layer, as compared with the case where the inductor wiring is not provided with the skirt portion. That is, the close contact force generated between the inductor wiring and the resin layer does not decrease with respect to the displacement force received by the inductor wiring from the protective film. Therefore, even when the displacement force acts on the inductor wiring from the protective film during the protective film removing process, it is possible to suppress displacement of the inductor wiring in the width direction due to the displacement force by an amount corresponding to the increase in the close contact force.

Then, the above-described inductor component can be manufactured by obtaining the protective film removing process and the element body forming process.

Other features, elements, characteristics and advantages of the present disclosure will become more apparent from the following detailed description of preferred embodiments of the present disclosure with reference to the attached drawings.

DETAILED DESCRIPTION

Figure 1:
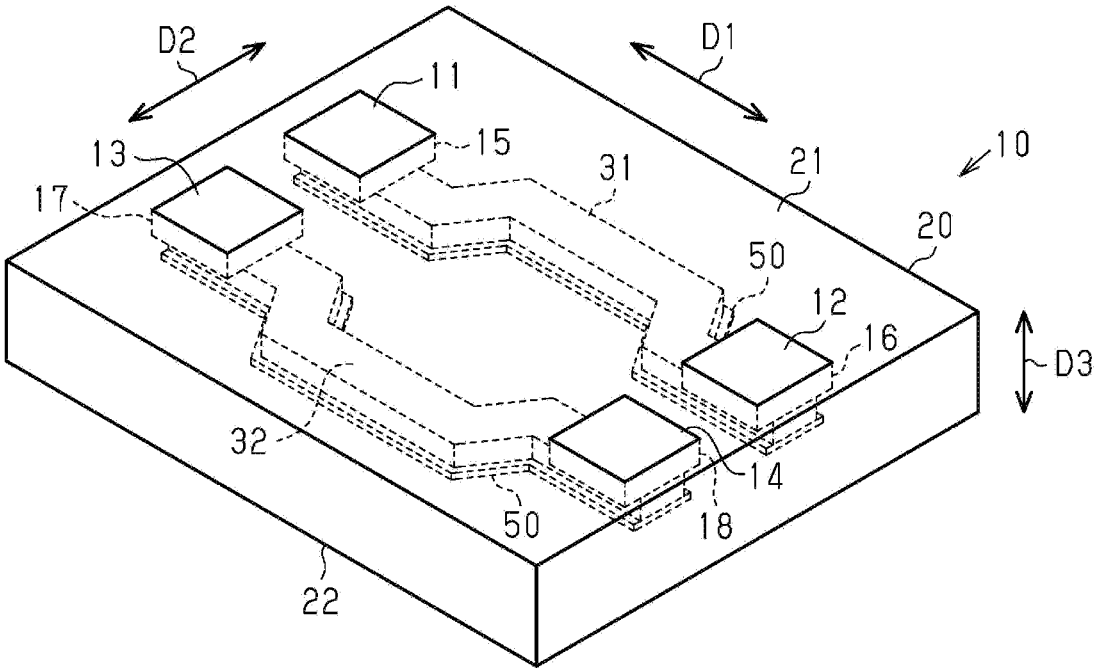
FIG. 1 is a perspective view schematically illustrating an embodiment of an inductor component.

Hereinafter, an embodiment of an inductor component and a method for manufacturing the inductor component will be described with reference to FIG. 1 to FIG. 15. Note that, constituent elements in the drawings are illustrated in an enlarged manner in some cases for ease of understanding. The dimensional ratio of the constituent elements may differ from the actual one or in another figure. In addition, hatching is given in a cross-sectional view, but hatching of some constituent elements may be omitted for ease of understanding.

Inductor Component

As illustrated in FIG. 1, an inductor component 10 includes an element body 20 made of a magnetic material. That is, the element body 20 has magnetism. For example, the element body 20 is made of a resin containing a metal magnetic powder. In a case where the element body 20 is formed of a resin containing a metal magnetic powder, examples of the metal magnetic powder include iron, nickel, chromium, copper, and aluminum, and alloys thereof. Further, as the resin containing a metal magnetic powder, a resin material such as an epoxy resin may be used. In consideration of insulation properties and moldability, it is preferable to employ a polyimide resin, an acrylic resin, and a phenol resin as the resin. Note that, in the case where the element body 20 is formed of a resin containing a metal magnetic powder, it is preferable that the element body 20 contain equal to or greater than about 60 wt % of the metal magnetic powder with respect to the total weight thereof. In addition, in order to improve a filling property of the resin containing the metal magnetic powder, it is more preferable that two kinds or three kinds of metal magnetic powders having different weight distributions be included in the resin.

Note that the element body 20 may be made of a resin containing a ferrite powder instead of a metal magnetic powder, or may be made of a resin containing both a metal magnetic powder and a ferrite powder.

In an example illustrated in FIG. 1, the element body 20 has a substantially rectangular parallelepiped shape. The shape of the element body 20 is not limited to a substantially rectangular parallelepiped, and may be, for example, a substantially columnar shape or a substantially polygonal shape.

In FIG. 1, an upper surface of the element body 20 is referred to as a "first main surface 21", and a lower surface of the element body 20 is referred to as a "second main surface 22". In an example illustrated in FIG. 1, the first main surface 21 has a substantially rectangular shape. In the present embodiment, a longitudinal direction of the first main surface 21 is referred to as a "first direction D1", and a short-side direction of the first main surface 21 is referred to as a "second direction D2". In addition, a direction orthogonal to both the first direction D1 and the second direction D2 is referred to as a "third direction D3". Since the first direction D1 and the second direction D2 are directions along the second main surface 22, the third direction D3 is also a direction orthogonal to the first main surface 21.

The inductor component 10 includes a plurality of external terminals provided on the first main surface 21 and a plurality of substantially columnar wirings connected to the external terminals. In the example illustrated in FIG. 1 and FIG. 2, four external terminals 11, 12, 13, and 14 are provided on the first main surface 21, and four substantially columnar wirings 15, 16, 17, and 18 are provided in the element body 20. Each of the substantially columnar wirings 15 to 18 extends in the third direction D3. Then, one ends of the substantially columnar wirings 15 to 18 are connected to the external terminals 11 to 14, respectively. On the other hand, other ends of the substantially columnar wirings 15 to 18 are located between the first main surface 21 and the second main surface 22 in the third direction D3, respectively.

Note that, in the element body 20, the external terminals 11 and 13 and the substantially columnar wirings 15 and 17 are each located on a first side in the first direction D1. In the element body 20, the external terminals 12 and 14 and the substantially columnar wirings 16 and 18 are each located on a second side in the first direction D1. In addition, in the element body 20, the external terminals 11 and 12 and the substantially columnar wirings 15 and 16 are each located on a first side in the second direction D2. In the element body 20, the external terminals 13 and 14 and the substantially columnar wirings 17 and 18 are each located on a second side in the second direction D2. In FIG. 1, the external terminals 11 to 14 and the substantially columnar wirings 15 to 18 are arranged symmetrically, but the present disclosure is not limited to this arrangement, and the positions may be shifted from each other.

The inductor component 10 includes an inductor wiring provided in the element body 20. In the example illustrated in FIG. 1 and FIG. 2, two inductor wirings 31 and 32 are provided in the element body 20. The inductor wirings 31 and 32 are disposed at positions different from each other in the second direction D2. That is, the second direction D2 may be also said to be a direction in which the plurality of inductor wirings 31 and 32 is arranged. The position of the inductor wiring 31 in the third direction D3 is the same as the position of the inductor wiring 32 in the third direction D3. Of course, the position of the inductor wiring 31 in the third direction D3 may be different from the position of the inductor wiring 32 in the third direction D3.

The inductor wirings 31 and 32 connect two substantially columnar wirings disposed at positions different from each other in the first direction D1. In the example illustrated in FIG. 1 and FIG. 2, the inductor wiring 31 is connected to the substantially columnar wiring 15 and the substantially columnar wiring 16. In addition, the inductor wiring 32 is connected to the substantially columnar wiring 17 and the substantially columnar wiring 18. That is, the inductor wiring 31 is located on the first side in the second direction D2, and the inductor wiring 32 is located on the second side in the second direction D2.

The inductor wirings 31 and 32 include copper and sulfur. Specifically, the inductor wirings 31 and 32 contain copper as a main component and contains sulfur having a content of equal to or greater than about "0.01 atomic %" and equal to or less than about "1 atomic %" (i.e., from about "0.01 atomic %" to about "1 atomic %").

Figure 2:
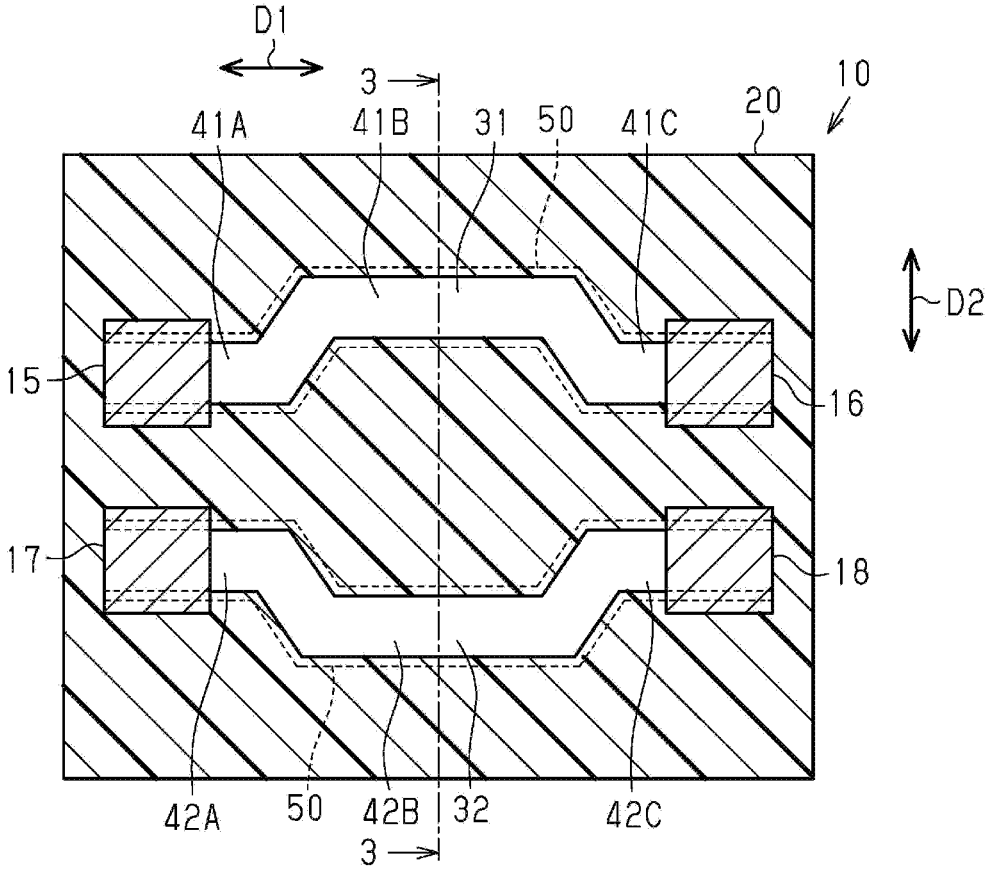
FIG. 2 is a cross-sectional view of the inductor component.
Figure 3:
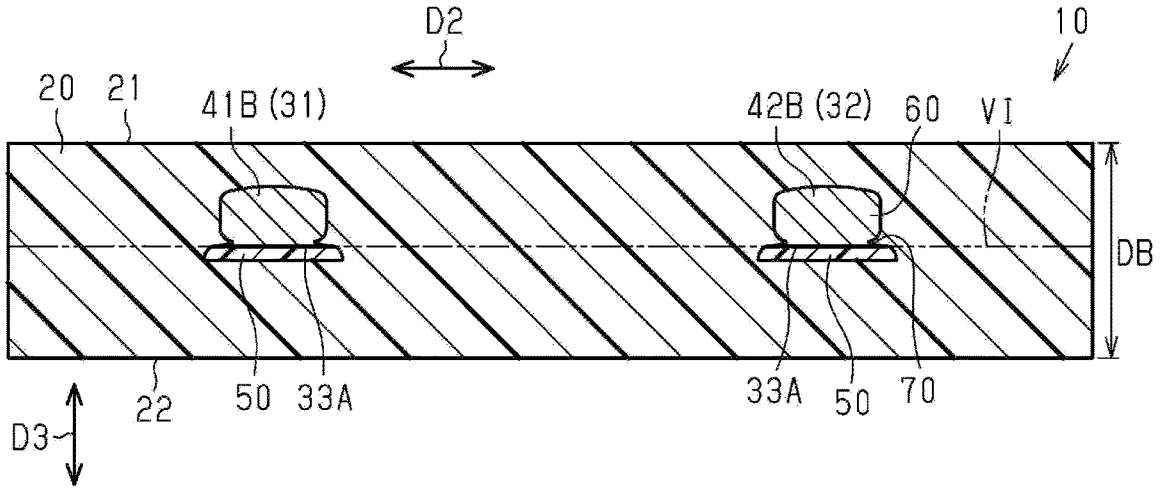
FIG. 3 is a view illustrating a cut plane of the inductor component taken along a line 3-3 in FIG. 2.

As illustrated in FIG. 2 and FIG. 3, the inductor component 10 includes a resin layer 50 provided in the element body 20. The resin layer 50 is disposed closer to the second main surface 22 side than the inductor wirings 31 and 32 in the third direction D3. Then, surfaces of the inductor wirings 31 and 32 on the second main surface 22 side in the third direction D3 is in surface contact with the resin layer 50. That is, the resin layer 50 and the inductor wirings 31 and 32 are provided in the element body 20 in a manner such that the inductor wirings 31 and 32 are stacked on the resin layer 50.

The resin layer 50 is a non-magnetic material. The resin layer 50 is, for example, a polyimide resin, an acrylic resin, an epoxy resin, a phenol resin, or the like. That is, it is preferable that the resin layer 50 contain fluorine or silicon at an atomic level. By containing a fluorine atom and a silicon atom in the resin layer 50 as described above, it is possible to improve the effect of suppressing the loss of a signal at a high frequency.

In particular, in the resin layer 50, it is preferable that a content rate of fluorine or silicon at the atomic level be higher as a distance from the inductor wirings 31 and 32 in the third direction D3 is smaller That is, in the resin layer 50, a content rate of fluorine or silicon in a portion close to the inductor wirings 31 and 32 is preferably higher than a content rate of fluorine or silicon in a portion away from the inductor wirings 31 and 32. By increasing the content rate of fluorine or silicon in the portion close to the inductor wirings 31 and 32 as described above, it is possible to effectively have an effect of suppressing the loss of the signal at a high frequency due to fluorine or silicon. Further, by increasing the content rate of silicon in the portion close to the inductor wirings 31 and 32, a close contact property between the resin layer 50 and the inductor wirings 31 and 32 can be increased.

Examples of a form of the fluorine atom contained in the resin layer 50 may include a trifluoromethyl group. The trifluoromethyl group may be present as a functional group in the resin, or may be present as an additive. Examples of another form of fluorine other than the trifluoromethyl group may include a difluoromethylene group, a monofluoromethylene group, a difluoromethyl group, a monofluoromethyl group, a pentafluoroethyl group, a trifluoroethyl group, a pentafluoropropyl group, a hexafluoroisopropyl group, a trifluorobutyl group, a pentafluorobutyl group, a heptafluorobutyl group, a monofluorophenyl group, a difluorophenyl group, a trifluorophenyl group, a tetrafluorophenyl group, and a hexafluorophenyl group.

Examples of a form of the silicon atom contained in the resin layer 50 include a silsesquioxane body. Further, examples of the form of the silicon atom other than the silsesquioxane body include a silanol group, silica, and silicone.

Next, the shape of the inductor wirings 31 and 32 will be described.

The inductor wiring 31 has a first end portion 41A connected to the substantially columnar wiring 15, a second end portion 41C connected to the substantially columnar wiring 16, and an intermediate portion 41B disposed between the first end portion 41A and the second end portion 41C in the first direction D1. The intermediate portion 41B is connected to both the first end portion 41A and the second end portion 41C. In addition, the intermediate portion 41B extends in the first direction D1. In the example illustrated in FIG. 2, the intermediate portion 41B is disposed at an outer side portion than the first end portion 41A and the second end portion 41C in the second direction D2. That is, the intermediate portion 41B is disposed on the first side relative to the first end portion 41A and the second end portion 41C in the second direction D2.

Note that the inductor wiring 31 has a substantially bent shape having three substantially linear shapes that extend parallel to the first direction D1 in each of the first end portion 41A, the intermediate portion 41B, and the second end portion 41C, and having two substantially linear shapes that connect the substantially linear shapes to each other and are oblique to the first direction D1 and the second direction D2. However, the inductor wiring 31 is not limited to such a substantially bent shape, and may have a substantially curved shape, and a part or all of the first end portion 41A, the intermediate portion 41B, and the second end portion 41C may be curved. Further, the inductor wiring 31 may have a combined shape of a substantially bent shape and a substantially curved shape.

The inductor wiring 32 has a first end portion 42A connected to the substantially columnar wiring 17, a second end portion 42C connected to the substantially columnar wiring 18, and an intermediate portion 42B disposed between the first end portion 42A and the second end portion 42C in the first direction D1. The intermediate portion 42B is connected to both the first end portion 42A and the second end portion 42C. In addition, the intermediate portion 42B extends in the first direction D1. In the example illustrated in FIG. 2, the intermediate portion 42B is disposed at an outer side portion than the first end portion 42A and the second end portion 42C in the second direction D2. That is, the intermediate portion 42B is disposed on the second side relative to the first end portion 42A and the second end portion 42C in the second direction D2.

Note that the inductor wiring 32 has a substantially bent shape having three substantially linear shapes that extend parallel to the first direction D1 in each of the first end portion 42A, the intermediate portion 42B, and the second end portion 42C, and having two substantially linear shapes that connect the substantially linear shapes to each other and are oblique to the first direction D1 and the second direction D2. However, the inductor wiring 32 is not limited to such a substantially bent shape, and may have a curved shape, and a part or all of the first end portion 42A, the intermediate portion 42B, and the second end portion 42C may be curved. Further, the inductor wiring 32 may have a combined shape of a substantially bent shape and a substantially curved shape.

Incidentally, broken lines in FIG. 2 indicate the resin layer 50 located closer to the second main surface 22 side than the inductor wirings 31 and 32 in the third direction D3.

FIG. 3 is a cross-sectional view of the inductor component 10 in a case where the intermediate portions 41B and 42B of the inductor wirings 31 and 32 and the element body 20 surrounding the intermediate portions 41B and 42B are cut. More specifically, the cross-section illustrated in FIG. 3 is a cross-section passing through the center of the element body 20 and orthogonal to a direction in which the intermediate portions 41B and 42B extend, i.e., a transverse plane of the intermediate portions 41B and 42B. Further, FIG. 4 is an enlarged view of a cut plane of the intermediate portion 41B of the inductor wiring 31 and the resin layer 50 in contact with the intermediate portion 41B in the cross section of FIG. 3.

Inside the element body 20, the inductor wirings 31 and 32 are provided along a first plane VI indicated by a dashed-two dotted line in FIG. 3. The first plane VI is a virtual plane. In an example illustrated in FIG. 3, the first plane VI is a plane parallel to the first main surface 21 and the second main surface 22. The first plane VI may not be a plane parallel to the first main surface 21 and the second main surface 22.

In transverse planes of the inductor wirings 31 and 32, a direction orthogonal to the first plane VI is referred to as a height direction of the inductor wirings 31 and 32, and a direction orthogonal to the height direction is referred to as a width direction of the inductor wirings 31 and 32. The transverse plane illustrated in FIG. 3 and FIG. 4 is a transverse plane of a portion of the inductor wirings 31 and 32 that extends in the first direction D1. As such, in FIG. 3 and FIG. 4, the height direction corresponds to the third direction D3, and the width direction corresponds to the second direction D2. However, in a transverse plane of a portion of the inductor wirings 31 and 32 that extends in a direction different from the first direction D1, the height direction is different from the third direction D3, and the width direction is different from the second direction D2.

Figure 4:
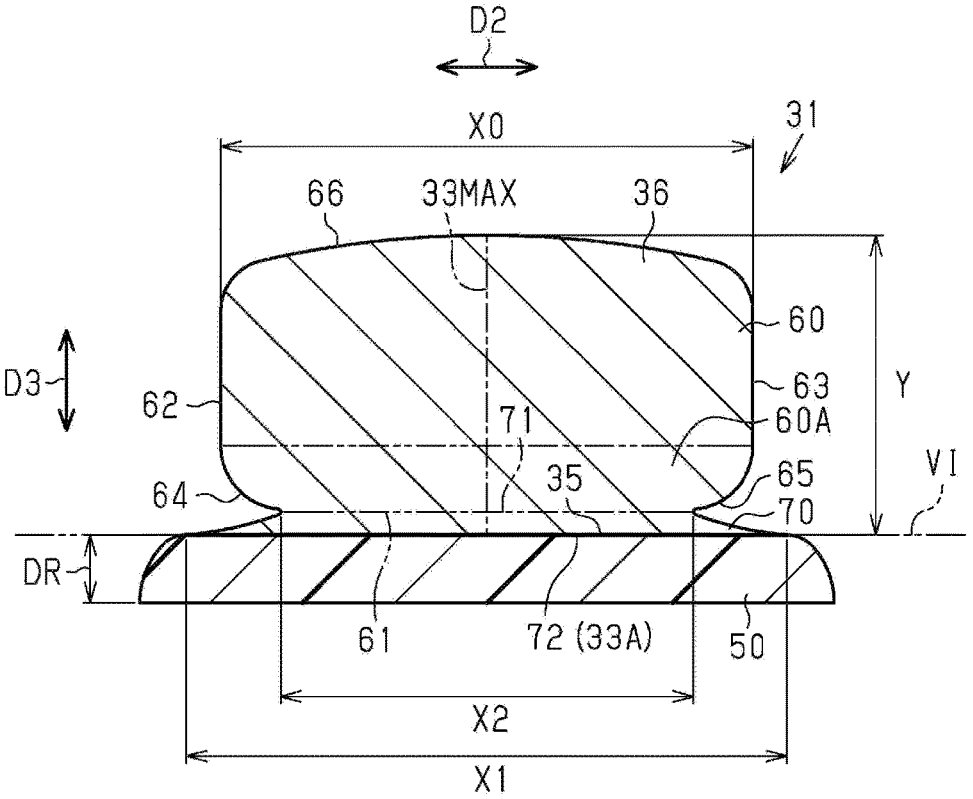
FIG. 4 is an enlarged view of a cut plane of an inductor wiring of the inductor component.

As illustrated in FIG. 3 and FIG. 4, the inductor wirings 31 and 32 has a wiring main body 60 and a skirt portion 70 that is adjacent to the wiring main body 60 in the third direction D3 corresponding to the height direction. The wiring main body 60 is located closer to the first main surface 21 side than the skirt portion 70 in the third direction D3. Therefore, the substantially columnar wirings 15 to 18 are connected to the wiring main body 60.

The wiring main body 60 has a substantially rectangular shape in a cross-section. That is, the wiring main body 60 has a connection site 61 with the skirt portion 70, a side wall surface 62 located on the first side with respect to the connection site 61 in the second direction D2 corresponding to the width direction, and a side wall surface 63 located on the second side relative to the connection site 61 in the second direction D2. The side wall surface 62 is connected to the connection site 61 via a connection portion 64. Similarly, the side wall surface 63 is connected to the connection site 61 via a connection portion 65. In the cut plane illustrated in FIG. 3 and FIG. 4, each of the connection portions 64 and 65 is configured such that a site closer to the skirt portion 70 in the third direction D3 comes closer to the center of the wiring main body 60 in the second direction D2. That is, in the wiring main body 60, a region surrounded by the connection portion 64 and the connection portion 65 in the width direction corresponds to a connection region 60A in which a dimension in the width direction increases as a distance from the connection site 61 in the height direction increases. That is, the wiring main body 60 has a shape having the connection region 60A. Further, the wiring main body 60 has an upper wall surface 66 that is further away from the resin layer 50 than the connection site 61 in the third direction D3, and is connected to the pair of side wall surfaces 62 and 63. In the cut plane illustrated in FIG. 4, the upper wall surface 66 has a substantially convex shape in a direction away from the resin layer 50. A dimension of the wiring main body 60 in the third direction D3 corresponding to the height direction is larger than a dimension of the skirt portion 70 in the third direction D3.

The skirt portion 70 is disposed between the wiring main body 60 and the resin layer 50. In the third direction D3, an end of the skirt portion 70 on the wiring main body 60 side is defined as a proximal end 71 of the skirt portion 70, and an end on the resin layer 50 side is defined as a distal end 72 of the skirt portion 70. At this time, the distal end 72 of the skirt portion 70 is in surface contact with the resin layer 50. That is, the distal end 72 of the skirt portion 70 can also be referred to as a contact surface 33A that is a surface of the inductor wirings 31 and 32 in contact with the resin layer 50.

The skirt portion 70 is configured such that a dimension in the width direction increases as a distance from the wiring main body 60 increases in the height direction. In the cut plane illustrated in FIG. 3 and FIG. 4, the dimension of the skirt portion 70 in the second direction D2 increases as the distance from the wiring main body 60 increases in the third direction D3. Therefore, a dimension X2 in the second direction D2 of the proximal end 71 of the skirt portion 70 is smaller than a dimension X1 in the second direction D2 of the distal end 72 of the skirt portion 70. Further, a dimension of the connection site 61 in the second direction D2 is smaller than a dimension X0 of the wiring main body 60 in the second direction D2, that is, an interval between the pair of side wall surfaces 62 and 63. Therefore, the dimension X2 in the second direction D2 of the proximal end 71 of the skirt portion 70 is smaller than the dimension X0 in the second direction D2 of the wiring main body 60.

On the other hand, the dimension X1 of the distal end 72 of the skirt portion 70 in the second direction D2 is larger than the dimension X0 of the wiring main body 60 in the second direction D2.

Incidentally, as illustrated in FIG. 4, the inductor wirings 31 and 32 have a shape in which a seed layer 35 and a conductive layer 36 having different compositions from each other are arranged in the third direction D3. The seed layer 35 and the conductive layer 36 are each made of a conductive material. The seed layer 35 is in contact with the resin layer 50. The conductive layer 36 is located on a side opposite to the resin layer 50 with the seed layer 35 interposed therebetween. That is, the distal end 72 of the skirt portion 70 is configured by the seed layer 35. A dimension of the seed layer 35 in the third direction D3 is smaller than half of the dimension of the skirt portion 70 in the third direction D3. Therefore, the entire wiring main body 60 is configured by the conductive layer 36. The proximal end 71 of the skirt portion 70 is also configured by the conductive layer 36.

Next, the size of the inductor component 10 and constituent elements of the inductor component 10 will be described.

As illustrated in FIG. 3, in a case where a dimension in the third direction D3 of the element body 20 is defined as a thickness DB of the element body 20, the element body 20 is configured to have the thickness DB of equal to or less than about "500 μm". That is, the inductor component 10 of the present embodiment is very thin.

As illustrated in FIG. 4, a maximum dimension in the third direction D3 of the resin layer 50 provided inside the element body 20 is defined as a thickness DR of the resin layer 50. In this case, the resin layer 50 is configured such that the thickness DR thereof is equal to or greater than about "5 μm" and equal to or less than about "30 μm" (i.e. from about "5 μm" to about "30 μm").

The inductor wirings 31 and 32 are configured so as to satisfy the following conditions. That is, the inductor wirings 31 and 32 are configured such that a configuration ratio Z is equal to or less than about "0.89" and equal to or greater than about "0.25" (i.e., from about "0.25" to about "0.89"). More preferably, the configuration ratio Z is set to be equal to or less than about "0.86". Note that the configuration ratio Z is a ratio of a dimension Y in the third direction D3 of a maximum site 33MAX with respect to a dimension in the second direction D2 of the contact surface 33A in the transverse plane illustrated in FIG. 3 and FIG. 4. The dimension of the contact surface 33A in the second direction D2 is a dimension X1 in the second direction D2 of the distal end 72 of the skirt portion 70. The maximum site 33MAX is a portion in which a dimension from the contact surface 33A to the upper wall surface 66 in the third direction D3 becomes maximum in the cut plane illustrated in FIG. 4. That is, in FIG. 3 and FIG. 4, since the third direction D3 is the height direction of the inductor wirings 31 and 32, the dimension Y in the third direction D3 of the maximum site 33MAX corresponds to a "maximum dimension" that is the largest dimension among the dimensions in the height direction in the transverse plane of the inductor wirings 31 and 32.

Method for Manufacturing Inductor Component

Next, with reference to FIG. 5 to FIG. 14, a description will be given of a method for manufacturing the inductor component 10 described above. The manufacturing method according to the present embodiment is a method using a semi-additive method.

Figure 5:
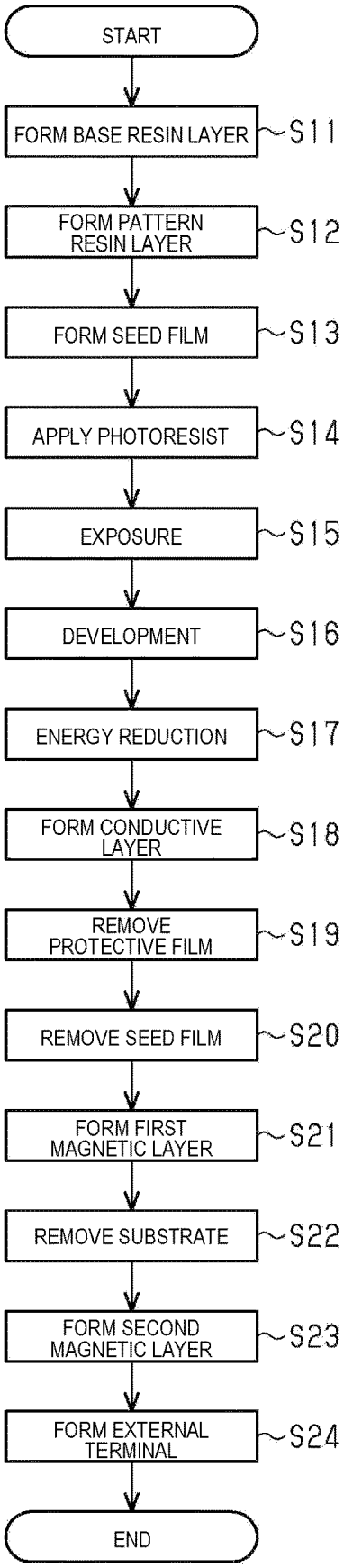
FIG. 5 is a flowchart explaining an embodiment of a method for manufacturing an inductor component.

As illustrated in FIG. 5, in a first step S11, a base resin layer is formed on a substrate.

Figure 6:
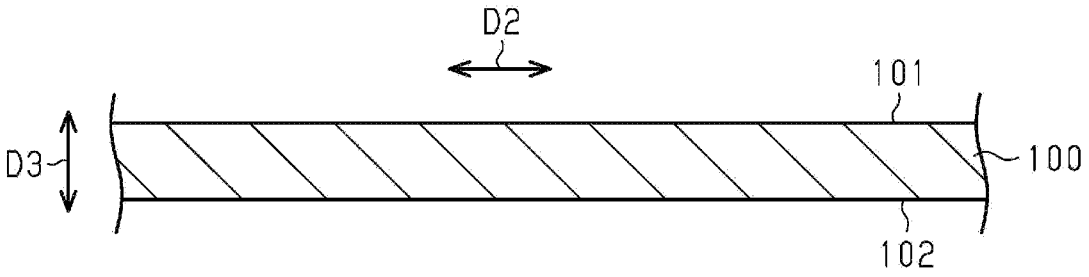
FIG. 6 is an explanatory diagram of the same manufacturing method.
Figure 7:
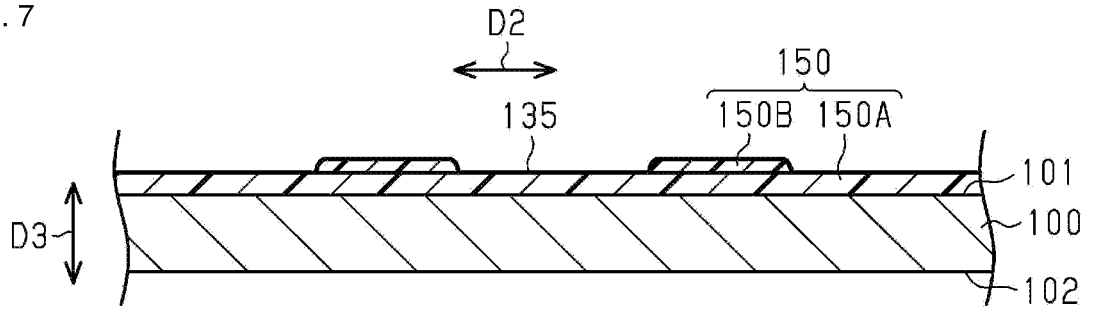
FIG. 7 is an explanatory diagram of the same manufacturing method.

That is, as illustrated in FIG. 6, a substrate 100 has a substantially plate-like shape. As a material of the substrate 100, for example, ceramics may be used. In FIG. 6, an upper surface of the substrate 100 is referred to as a front surface 101, and a lower surface of the substrate 100 is referred to as a back surface 102. As illustrated in FIG. 7, a base resin layer 150A is formed on the substrate 100 so as to cover the entire front surface 101 of the substrate 100. The base resin layer 150A is made of the same non-magnetic material as that of the resin layer 50 configuring the inductor component 10. For example, the base resin layer 150A can be formed by applying a polyimide varnish including a trifluoromethyl group and a silsesquioxane to the front surface 101 of the substrate 100 by spin coating.

When the formation of the base resin layer 150A is completed, the processing proceeds to a next step S12. In step S12, a pattern resin layer 150B is formed on the base resin layer 150A. At least an upper portion of the pattern resin layer 150B in FIG. 7 configures the resin layer 50 of the inductor component 10. For example, the pattern resin layer 150B can be formed by patterning a non-magnetic insulating resin on the base resin layer 150A by known photolithography. In this case, a polyimide varnish of the same kind as that used for forming the base resin layer 150A is used, and the pattern resin layer 150B is formed. That is, in the present embodiment, a "resin layer forming process" of forming a resin layer 150 formed of the base resin layer 150A and the pattern resin layer 150B on the substrate 100 is configured by steps S11 and S12.

When the formation of the pattern resin layer 150B is completed, the processing proceeds to a next step S13. In step S13, a seed film 135 is formed. That is, as illustrated in FIG. 7, the seed film 135 is formed so as to cover the entire upper surface of the resin layer 150 in the figure. For example, the seed film 135 containing copper is formed by sputtering. Of the seed film 135 like this, a portion located on the pattern resin layer 150B functions as the seed layer 35 configuring the inductor wirings 31 and 32 of the inductor component 10. For example, in step S13, the seed film 135 having a thickness of about "200 nm" is formed. Therefore, in the present embodiment, step S13 corresponds to a "seed film forming process" in which the seed film 135 is formed on the resin layer 150.

Figure 8:
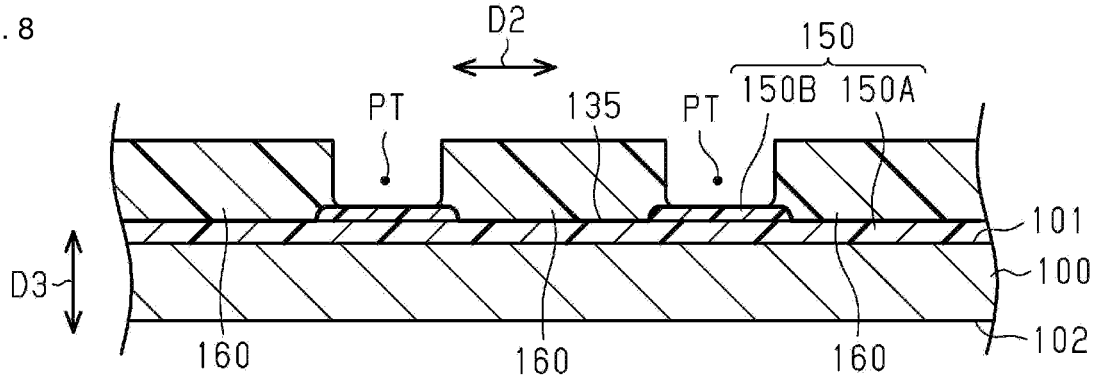
FIG. 8 is an explanatory diagram of the same manufacturing method.

When the formation of the seed film 135 is completed, the processing proceeds to a next step S14. In step S14, a photoresist is applied to the entire seed film 135. For example, a photoresist is applied onto the seed film 135 by spin coating. Then, in a next step S15, exposure using an exposure device is performed. Accordingly, a portion of the photoresist that is adhered on the pattern resin layer 150B can be removed by development processing described later, and the other portion is cured. Note that in a case where a negative resist is employed as the photoresist, an exposed portion of the photoresist is cured, and the other portion can be removed. On the other hand, in a case where a positive resist is employed as the photoresist, an exposed portion of the photoresist becomes removable, and the other portion is cured. As a result, by controlling the portion to be exposed of the photoresist, as illustrated in FIG. 8, a part of the portion adhered to the pattern resin layer 150B can be cured.

Subsequently, in step S16, development processing is performed. That is, as illustrated in FIG. 8, the portion of the photoresist adhered to the pattern resin layer 150B is removed by the processing using a developer. In addition, the cured portion of the photoresist remains on the seed film 135 as the protective film 160. In this case, a part of the portion of the photoresist that is adhered to the pattern resin layer 150B remains even when the development processing is performed. By patterning the protective film 160 on the seed film 135 as described above, a wiring pattern PT in which the shape of the inductor wirings 31 and 32 in the inductor component 10 is opened is formed. Therefore, in the present embodiment, a "pattern forming process" is configured by steps S14 to S16.

When the formation of the wiring pattern PT is completed, the processing proceeds to a next step S17. In step S17, a surface energy of the seed film 135 in contact with the protective film 160 is lowered. In the present embodiment, an "energy lowering process" is configured by step S17. That is, in the processing in step S17, the substrate 100 on which the protective film 160 is formed is left. For example, in step S17, the substrate 100 is left for an equal to or more than prescribed time in an atmosphere having a predetermined temperature and humidity. The predetermined temperature is a temperature in the range of about "20° C." to about "30° C.". For example, as the predetermined temperature, about "25° C." may be set. Further, the predetermined humidity is a humidity in the range of about "45%" to about "55%". For example, about "50%" may be set as the predetermined humidity. Further, for example, a time equal to or longer than about "24 hours" is set as the prescribed time.

Note that in the processing of step S17, the substrate 100 on which the protective film 160 is formed may be left and then subjected to a heating and drying treatment. The heating and drying treatment refers to a thermal annealing treatment. For example, processing of heating the substrate 100 at a temperature of about "100° C." for a predetermined period of time at a hot plate may be performed. The predetermined time is preferably set to a time equal to or longer than about "5 minutes". For example, as the predetermined time, about "10 minutes" may be set. The temperature of the thermal annealing treatment is preferably set to a temperature of equal to or higher than about "30° C." and equal to or lower than about "500° C.". Incidentally, the thermal annealing treatment of the substrate 100 is not essential. Alternatively, instead of leaving the substrate 100 in an atmosphere at a predetermined temperature and humidity for an equal to or more than predetermined time, a thermal annealing treatment may be performed.

Figure 9:
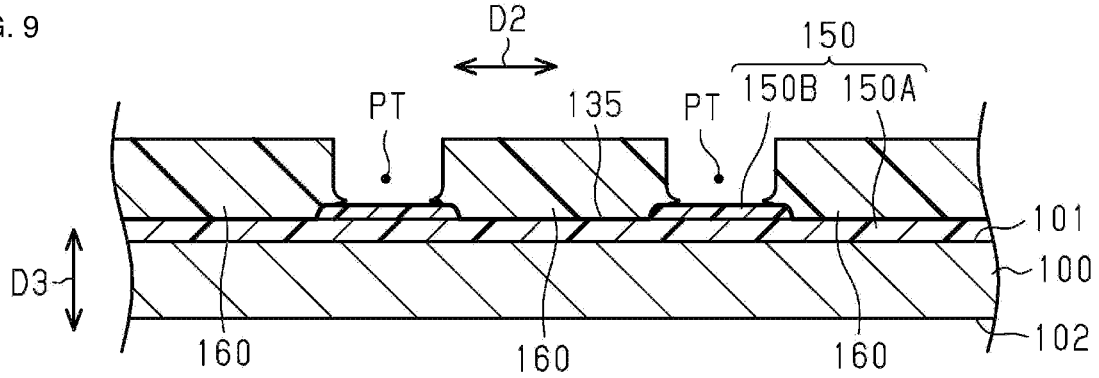
FIG. 9 is an explanatory diagram of the same manufacturing method.

When the seed film 135 comes into contact with air, the surface energy of the seed film 135 decreases. When at least one of the leaving of the substrate 100 and the heating of the substrate 100 is performed as described above, the surface energy of the seed film 135 in contact with the protective film 160 decreases, and the adhesion between the seed film 135 and the protective film 160 is reduced. When the thermal annealing treatment is performed on the substrate 100, a polarity energy of the surface due to lattice defects and grain boundaries of the seed film 135 decreases. As a result, the energy of the seed film 135 is lowered. As described above, when the polarity energy of the surface of the seed film 135 is lowered, a portion of the protective film 160 that partitions the wiring pattern PT on the pattern resin layer 150B peels off from the seed film 135, as illustrated in FIG. 9.

Incidentally, in a case where the surface energy of the seed film 135 in contact with the protective film 160 is lowered by being left, an amount of decrease in the surface energy can be controlled with high accuracy as compared with a case where heating is performed. That is, the degree of peeling from the seed film 135 in the portion, of the protective film 160, which partitions the wiring pattern PT on the pattern resin layer 150B can be accurately adjusted. As a result, it is possible to form the skirt portion 70 with high accuracy, and in turn, it is possible to suppress variation in the shape of the skirt portion 70 for each product. On the other hand, in a case where the surface energy of the seed film 135 in contact with the protective film 160 is lowered by heating, the surface energy may be lowered in a shorter time than in the case where it is left unattended.

When the processing in step S17 is completed, the processing proceeds to a next step S18. In step S18, the conductive layer 36 is formed by supplying a conductive material into the wiring pattern PT. As described above, the portion of the protective film 160 that partition the wiring patterns PT is peeled off from the seed film 135. Therefore, a conductive material flows also between the seed film 135 and the protective film 160 that is peeled off from the seed film 135. Accordingly, the conductive layer 36 is formed on a portion of the seed film 135, the portion being not covered with the protective film 160. For example, by performing electrolytic copper plating using a copper sulfate aqueous solution, copper and a trace amount of sulfur are mainly precipitated in an exposed portion of the seed film 135. Thereby, the conductive layer 36 is formed. Since the copper sulfate aqueous solution is used, the conductive layer 36 contains sulfur. The inductor wirings 31 and 32 are formed by the seed layer 35 that is a portion of the seed film 135 and that is in contact with the conductive layer 36, and the conductive layer 36. The inductor wirings 31 and 32 formed as described above have the wiring main body 60 and the skirt portion 70 adjacent to the wiring main body 60 in the height direction. Therefore, in the present embodiment, step S18 corresponds to a "conductive layer forming process".

Figure 10:
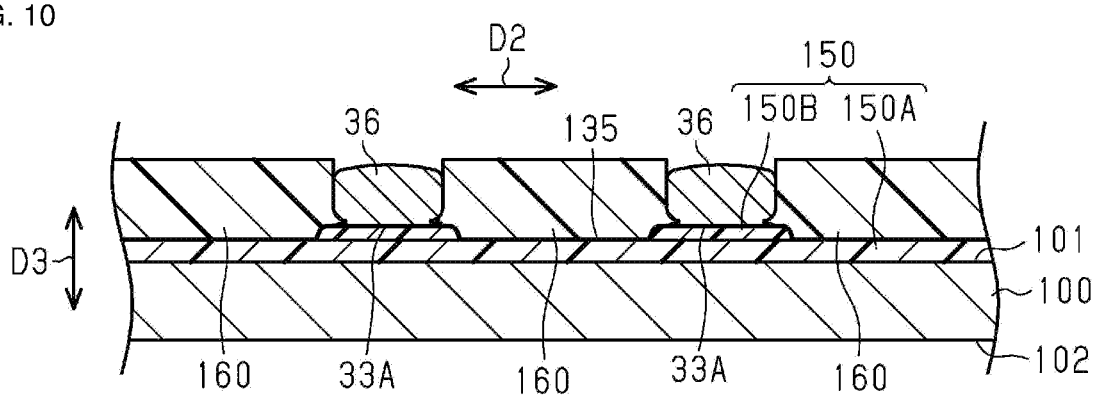
FIG. 10 is an explanatory diagram of the same manufacturing method.

As illustrated in FIG. 10, a lower surface of the seed film 135 located on the pattern resin layer 150B in the figure corresponds to the contact surface 33A of the inductor wirings 31 and 32. Then, in step S18, the conductive layer 36 is formed such that the above-described configuration ratio Z is equal to or less than about "0.89" and equal to or greater than about "0.25" (i.e., from about "0.25" to about "0.89"). More preferably, the conductive layer 36 is formed such that the configuration ratio Z is equal to or less than about "0.86". For example, a predetermined configuration ratio Z may be obtained by an energization time of the electrolytic copper plating.

Figure 11:
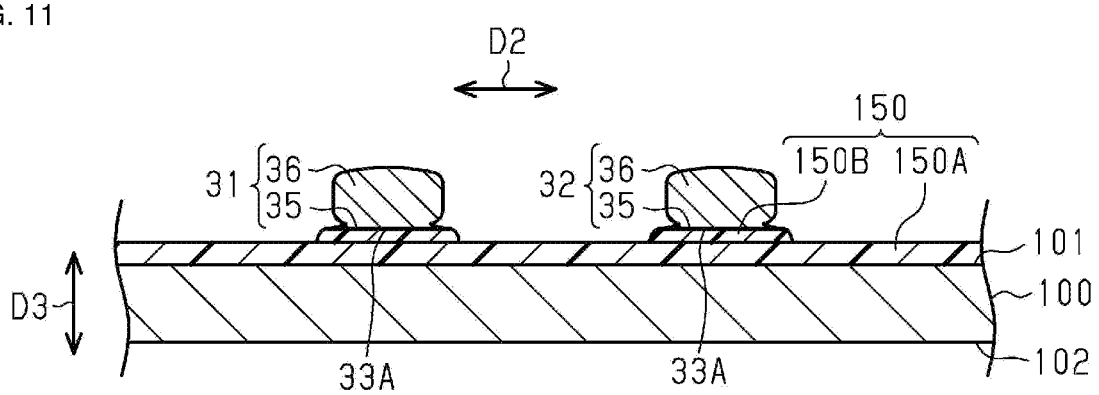
FIG. 11 is an explanatory diagram of the same manufacturing method.

When the formation of the conductive layer 36 is completed, the processing proceeds to a next step S19. In step S19, the protective film 160 is removed as illustrated in FIG. 11 by the processing using a stripping solution. Therefore, in the present embodiment, step S19 corresponds to a "protective film removing process".

When peeling of the protective film 160 is completed, the processing proceeds to a next step S20. In step S20, the seed film 135 is removed. For example, the seed film 135 is removed by processing using strong acid such as nitric acid. As a result, the portion of the seed film 135 that is a portion other than the seed layer 35 configuring the inductor wirings 31 and 32 together with the conductive layer 36 is removed.

Figure 12:
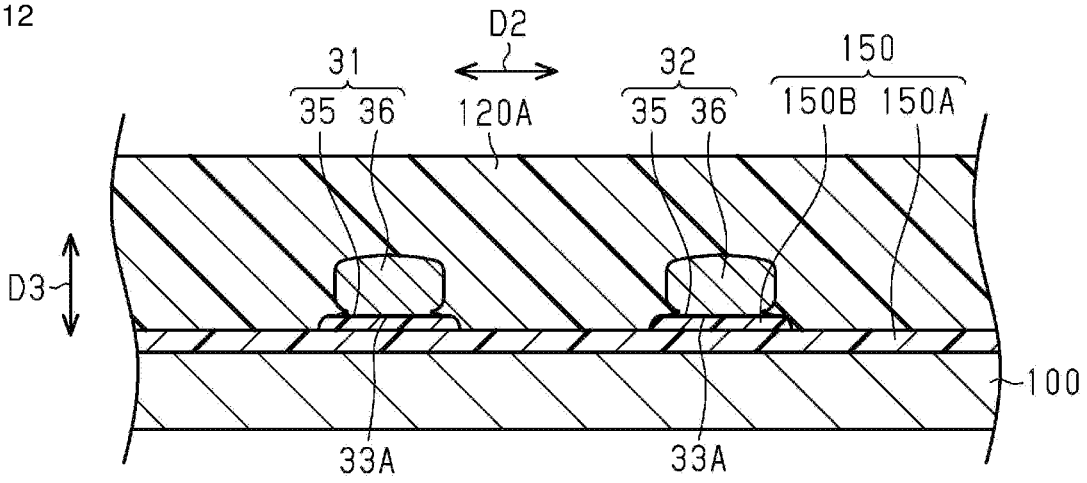
FIG. 12 is an explanatory diagram of the same manufacturing method.

When the removal of the seed film 135 is completed, the processing proceeds to a next step S21. In step S21, as illustrated in FIG. 12, a first magnetic layer 120A covering the conductive layer 36 is formed from an upper surface side in the figure. For example, in a case where the element body 20 is configured by a resin containing a metal magnetic powder, a resin containing the metal magnetic powder that is a material of the first magnetic layer 120A is applied. Examples of the metal magnetic powder include iron, nickel, chromium, copper, and aluminum. Further, as the resin containing a metal magnetic powder, a resin material such as an epoxy resin may be used. In consideration of insulation properties and moldability, it is preferable to employ a polyimide resin, an acrylic resin, and a phenol resin as a resin containing a metal magnetic powder. Subsequently, the resin containing the metal magnetic powder is solidified by press working. As a result, the first magnetic layer 120A is formed.

Note that, in a case where the substantially columnar wirings 15 to 18 are provided as in the inductor component 10 described above, the substantially columnar wirings 15 to 18 are formed before the first magnetic layer 120A is formed. Then, in the processing of forming the first magnetic layer 120A, the formed first magnetic layer 120A is ground such that ends on sides not contacting with the inductor wirings 31 and 32 are exposed in both the ends of substantially columnar wiring 15 to 18. The first magnetic layer 120A may be a single layer, or may be a layer in which a plurality of magnetic layers is stacked in order to achieve a predetermined thickness.

Figure 13:
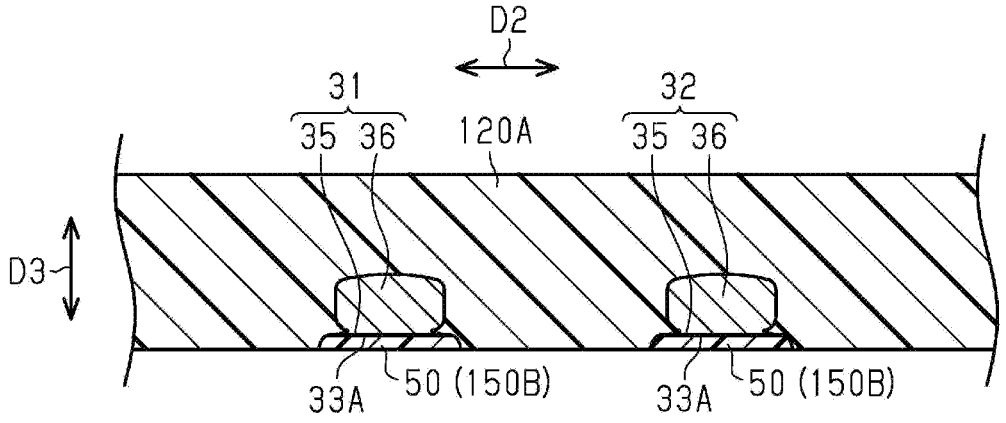
FIG. 13 is an explanatory diagram of the same manufacturing method.

When the formation of the first magnetic layer 120A is completed, the processing proceeds to a next step S22. In step S22, as illustrated in FIG. 13, the substrate 100 and the base resin layer 150A are removed by grinding. At this time, a part of the pattern resin layer 150B or the entire pattern resin layer 150B may be removed.

Figure 14:
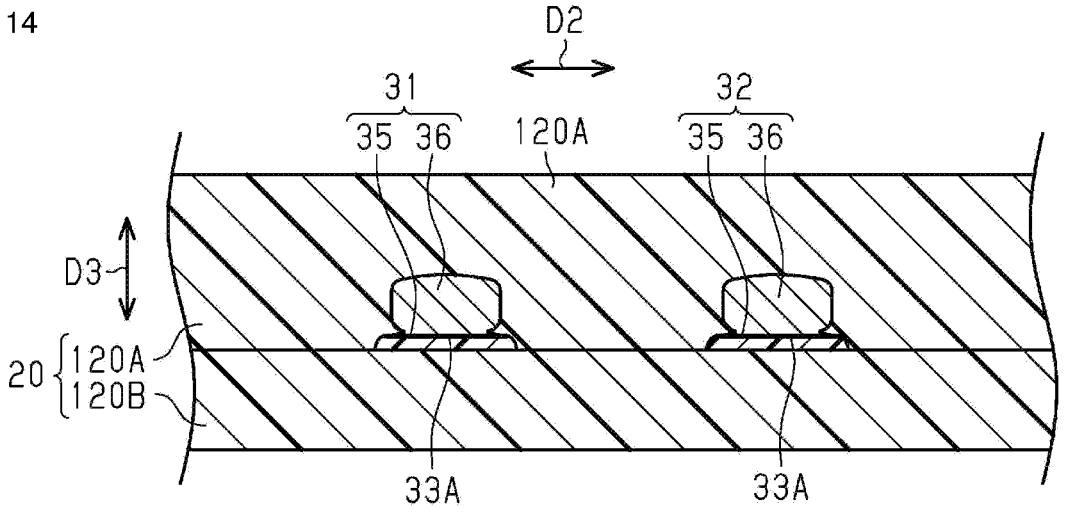
FIG. 14 is an explanatory diagram of the same manufacturing method.

When the processing of such removal is completed, the processing proceeds to a next step S23. In step S23, as illustrated in FIG. 14, a second magnetic layer 120B is formed on the side opposite to the first magnetic layer 120A in the third direction D3. That is, a resin containing a metal magnetic powder that is a material of the second magnetic layer 120B is applied. Subsequently, the resin containing the metal magnetic powder is solidified by press working. The resin is ground as needed. As a result, the second magnetic layer 120B is formed. The second magnetic layer 120B may be a single layer, or may be a layer in which a plurality of magnetic layers is stacked in order to achieve a predetermined thickness. When the second magnetic layer 120B is formed as described above, the inductor wirings 31 and 32 are sandwiched between the first magnetic layer 120A and the second magnetic layer 120B. The element body 20 is configured by these first magnetic layer 120A and the second magnetic layer 120B. Therefore, in the present embodiment, an "element-body forming process" of forming the element body 20 inside which the inductor wirings 31 and 32 are provided is configured by steps S21 to S23.

When the formation of the second magnetic layer 120B is completed, the processing proceeds to a next step S24. In step S24, the external terminals 11 to 14 are formed. At this time, an insulating film, such as a solder resist, for exposing the external terminals 11 to 14 may be formed on the first main surface 21 of the element body 20. Accordingly, the series of processing configuring the manufacturing method of the inductor component 10 is terminated.

EXAMPLES

Next, referring to FIG. 15, a description will be made of a comparison between an inductor component of a comparative example and the inductor component 10 of an example. The inductor component of the comparative example and the inductor component 10 of the example differ in the configuration ratio Z by changing the dimension X1 and the dimension Y, and the other configurations are the same.

Figures 15, 16:
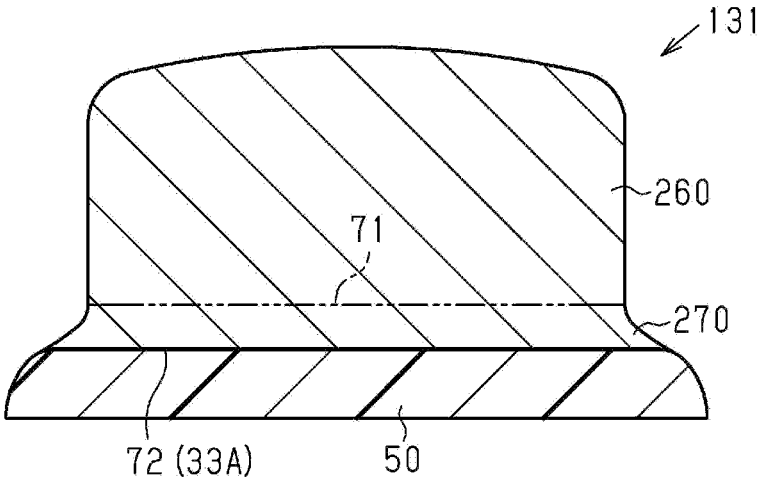
FIG. 15 is a table showing comparison results between an inductor component of an example and an inductor component of a comparative example.
FIG. 16 is a view illustrating a cut plane of an inductor wiring in an inductor component according to a modified example.

In FIG. 15, in the inductor component of Comparative Example 1, the inductor wiring does not include the skirt portion 70. That is, a portion corresponding to the connection site 61 of the wiring main body 60 corresponds to the contact surface 33A of the inductor wiring. For that reason, in Comparative Example 1, the configuration ratio Z of the inductor wiring is approximately "0.92". On the other hand, in the inductor component 10 of Examples 1, 2, and 3, the inductor wirings 31 and 32 have the skirt portion 70. In Example 1, the configuration ratio Z of the inductor wirings 31 and 32 is approximately "0.86". In Example 2, the configuration ratio Z of the inductor wirings 31 and 32 is approximately "0.89". In Example 3, the configuration ratio Z of the inductor wirings 31 and 32 is approximately "0.86".

In addition, in Comparative Example 1, Example 1, and Example 2, the resin layer 50 is provided inside the element body 20, and the inductor wirings 31 and 32 are in contact with the resin layer 50. On the other hand, in Comparative Example 3, the resin layer 50 is not provided inside the element body 20. That is, in the process of manufacturing the inductor component 10, the resin layer 50 is completely removed.

A deviation occurrence rate R illustrated in FIG. 15 is a probability that a deviation occurs between an actual position and a design position in the second direction D2 of the inductor wirings 31 and 32 after the inductor component 10 is completed. The design position refers to the position of the inductor wirings 31 and 32 defined by the design. In a case where the inductor component 10 is manufactured in a large amount by the above-described manufacturing method, the higher the deviation occurrence rate R, the lower a yield rate of the inductor component 10 is.

As illustrated in FIG. 15, in Comparative Example 1, since the configuration ratio Z is larger than about "0.89", the deviation occurrence rate R is high. On the other hand, in Examples 1 to 3, since the configuration ratio Z is equal to or less than about "0.89", the deviation occurrence rate R is low. In particular, in Examples 1 and 3, since the configuration ratio Z is equal to or less than about "0.86", the deviation occurrence rate R can be further made small.

The reason why the deviation occurrence rate R can be reduced by setting the configuration ratio Z to be equal to or less than about "0.89" will be described. The inductor wirings 31 and 32 extend generally in the first direction D1. In the process of manufacturing the inductor component 10, as illustrated in FIG. 10, the protective film 160 formed of a photoresist is disposed on both sides in the second direction D2 of the conductive layer 36 configuring the inductor wirings 31 and 32. Then, when the protective film 160 is removed using the peeling liquid, the protective film 160 is swelled by the stripping solution. That is, the protective film 160 tends to spread in the second direction D2. Then, the conductive layer 36 adjacent to the protective film 160 is pressed by the protective film 160. That is, due to the swelling of the protective film 160, a displacement force, which is a force for displacing the inductor wirings 31 and 32 in the second direction D2, acts on the inductor wirings 31 and 32 including the conductive layer 36.

On the other hand, the inductor wirings 31 and 32 are in close contact with the pattern resin layer 150B, i.e., the resin layer 50. Therefore, a close contact force, which is a force for retaining a positional relationship between the pattern resin layer 150B and the inductor wirings 31 and 32, is generated between the inductor wirings 31 and 32 and the pattern resin layer 150B.

When the close contact force is small with respect to the displacement force, the positions of the inductor wirings 31 and 32 are displaced in the second direction D2 by the displacement force. On the other hand, when the close contact force is sufficiently large with respect to the displacement force, the positions of the inductor wirings 31 and 32 are not displaced in the second direction D2 even when the displacement force acts.

As the dimension Y of the inductor wirings 31 and 32 in the third direction D3 is larger, the displacement force received by the inductor wirings 31 and 32 from the protective film 160 increases. On the other hand, as the dimension X1 of the contact surface 33A of the inductor wirings 31 and 32 in the second direction D2 is larger, the close contact force generated between the inductor wirings 31 and 32 and the pattern resin layer 150B increases.

Incidentally, as the configuration ratio Z of the inductor wirings 31 and 32 is smaller, the dimension Y in the third direction D3 of the inductor wirings 31 and 32 can be made smaller, and thus the displacement force received by the inductor wirings 31 and 32 from the protective film 160 can be reduced. Further, as the configuration ratio Z of the inductor wirings 31 and 32 is smaller, the dimension X1 of the contact surface 33A in the second direction D2 becomes larger, and thus the close contact force generated between the inductor wirings 31 and 32 and the pattern resin layer 150B can be increased.

As illustrated in FIG. 15, in Comparative Example 1, since the configuration ratio Z is large, the dimension Y of the inductor wirings 31 and 32 in the third direction D3 increases or the dimension X1 of the contact surface 33A in the second direction D2 decreases. Therefore, the deviation occurrence rate R increases.

On the other hand, in Examples 1 to 3, since the configuration ratio Z is small, it is possible to suppress an increase of the dimension Y of the inductor wirings 31 and 32 in the third direction D3, and the dimension X1 of the contact surface 33A in the second direction D2 can be increased. That is, the close contact force generated between the inductor wirings 31 and 32 and the pattern resin layer 150B can be increased while the displacement force acting on the inductor wirings 31 and 32 is reduced. As a result, the deviation occurrence rate R can be reduced compared with the case of the Comparative Example 1. Therefore, it is possible to suppress a change in the performance of the inductor component 10.

Further, by setting the configuration ratio Z to be equal to or less than about "0.86" as in Examples 1 and 3, the displacement force acting on the inductor wirings 31 and 32 can be further reduced, and the close contact force generated between the inductor wirings 31 and 32 and the pattern resin layer 150B can be further increased. As a result, the deviation occurrence rate R can be further reduced, and the effect of suppressing the change in the performance of the inductor component 10 can be increased.

In the present embodiment, the following effects can be further obtained.

The smaller the configuration ratio Z is, the smaller the thickness of the inductor wirings 31 and 32 is. Then, the thinner the inductor wirings 31 and 32 are, the higher the wiring resistance of the inductor wirings 31 and 32 is. The high wiring resistance of the inductor wirings 31 and 32 is not preferable as the inductor component 10. In this regard, in the present embodiment, the inductor wirings 31 and 32 are configured such that the configuration ratio Z is equal to or greater than about "0.25". Accordingly, it is possible to suppress becoming excessively large of the wiring resistance of the inductor wirings 31 and 32.

The above-described embodiments may be modified as follows. The embodiments described in the above and the following modification may be implemented in combination with each other within a scope that does not contradict the technical scope of the present disclosure.

An inductor wiring may have a shape different from the shape described in the above embodiment as long as the inductor wiring has a wiring main body and a skirt portion adjacent to the wiring main body in the height direction. For example, the inductor wiring may be a wiring having a shape as illustrated in FIG. 16. That is, as illustrated in FIG. 16, although an inductor wiring 131 includes a skirt portion 270, a wiring main body 260 may not include the connection region 60A. Even in such a configuration, since the dimension in the width direction of the distal end 72 of the skirt portion 270 is larger than the dimension in the width direction of the proximal end 71 of the skirt portion 270, the dimension in the width direction in the contact surface 33A of the inductor wiring can be increased as compared with a case where the inductor wiring does not include the skirt portion 270. Thereby, the close contact force between the inductor wiring 131 and the resin layer 50 can be increased, and thus the deviation between the position of the inductor wiring 131 and the design position can be suppressed inside the element body 20.

The seed layer 35 may be a layer formed using a metal other than copper as a material. Examples of the other metals include titanium, silver, chromium, nickel, and the like.

In a case where the inductor component 10 is manufactured by a method different from the manufacturing method described in the above-described embodiment, the seed layer 35 is not essential.

The inductor component 10 does not have to be manufactured in one unit as in the manufacturing method described in the above embodiment, and portions to be a plurality of inductor components 10 may be arranged in a matrix form on the substrate 100, and may be singulated by dicing or the like in step S23 and subsequent steps.

The skirt portion 70 may be formed such that the dimension of the seed layer 35 in the third direction D3 is equal to or more than half the dimension of the skirt portion 70 in the third direction D3.

The inductor wiring provided inside the element body 20 may have a shape different from the shape described in the above-described embodiment. The inductor wiring has not particularly limitation in a structure, a shape, a material, and the like as long as the inductor wiring can provide an inductance to the inductor component 10 by generating magnetic flux around the inductor wiring when a current flows therethrough. The inductor wiring may be a wire having various known wiring shapes, such as a spiral shape of equal to or more than one turn, a curved shape of less than 1.0 turn, or a meandering meander shape.

In the above embodiment, two inductor wirings 31 and 32 are provided inside the element body 20. However, the number of the inductor wirings provided inside the element body 20 may be a number other than "2". For example, in the inductor component 10, equal to or more than three inductor wirings may be provided in the element body 20, or one inductor wiring may be provided in the element body 20.

The first direction D1 and the second direction D2 may be different from the directions illustrated in FIG. 1 as long as they are directions along the first main surface 21.

The resin layer 50 may contain a filler such as silica or barium sulfate, or may be a resin layer having magnetism.

The inductor component 10 may have a configuration in which the resin layer 50 is not provided.

The energy lowering process may be processing other than processing of leaving the substrate 100 on which the protective film 160 is formed or of performing thermal annealing on the substrate 100 as long as the surface energy of the seed film 135 can be lowered. For example, as the other processing, for example, a surface oxidation treatment, processing of applying a coupling agent including an alkyl chain or a fluoroalkyl chain to a terminal may be exemplified.

The inductor component 10 may be manufactured by another manufacturing method that does not utilize a semi-additive method. For example, the inductor component 10 may be formed by a sheet lamination method, a printing lamination method, or the like, and the inductor wirings 31 and 32 may be formed by a thin film method such as sputtering, vapor deposition, or the like, a thick film method such as printing and application, or a plating method such as a full additive method, or a subtractive method. Even in this case, the inductor wirings 31 and 32 may receive the displacement force in some cases from the members located on both sides in the second direction D2 of the inductor wirings 31 and 32 in the manufacturing process or after the manufacturing process. At this time, by setting the configuration ratio Z to be equal to or less than about "0.89", it is possible to suppress an increase in the displacement force while increasing the close contact force. Therefore, in the inductor component 10, it is possible to suppress the occurrence of a deviation between the position of the inductor wirings 31 and 32 and the design position inside the element body 20, regardless of the manufacturing method.

According to the inductor component and the method for manufacturing the inductor component, it is possible to suppress the deviation between the position of the inductor wiring and the design position inside the element body.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor component comprising:

an element body having magnetism; and an inductor wiring provided along a first plane inside the element body, such that the inductor wiring is inside and surrounded by the element body having magnetism, wherein in a case where a direction orthogonal to the first plane is defined as a height direction of the inductor wiring, and a direction orthogonal to both a direction in which the inductor wiring extends and the height direction among directions along the first plane is defined as a width direction of the inductor wiring, the inductor wiring has a wiring main body and a skirt portion adjacent to the wiring main body in the height direction, and a dimension in the height direction of the wiring main body is larger than a dimension in the height direction of the skirt portion, and the skirt portion has a larger dimension in the width direction as a distance from the wiring main body in the height direction increases, in a case where an end of the skirt portion on a side of the wiring main body in the height direction is defined as a proximal end and an end of the skirt portion on a side opposite to the wiring main body in the height direction is defined as a distal end, a dimension of the distal end of the skirt portion in the width direction is larger than a dimension of the wiring main body in the width direction, in a transverse plane of the inductor wiring that is orthogonal to a direction in which the inductor wiring extends, an angle between a connection portion of the wiring main body and the skirt portion is an acute angle, and the connection portion facing the skirt portion is an arced projected surface which projects toward the skirt portion.

2. The inductor component according to claim 1, wherein the wiring main body has a connection region in which a dimension in the width direction increases as a distance from a connection site of the skirt portion increases in the height direction.

3. The inductor component according to claim 1, wherein in a case where in a transverse plane of the inductor wiring that is orthogonal to a direction in which the inductor wiring extends, a largest dimension among dimensions in the height direction is defined as a maximum dimension, a ratio of the maximum dimension to a dimension in the width direction of the distal end of the skirt portion is equal to or less than 0.89.

4. The inductor component according to claim 1, wherein in a case where in a transverse plane of the inductor wiring that is orthogonal to a direction in which the inductor wiring extends, a largest dimension among dimensions in the height direction is defined as a maximum dimension, a ratio of the maximum dimension to a dimension in the width direction of the distal end of the skirt portion is equal to or less than 0.86.

5. The inductor component according to claim 1, wherein the inductor wiring has a structure in which a seed layer and a conductive layer having different compositions from each other are arranged in the height direction, and the distal end of the skirt portion is configured by the seed layer.

6. The inductor component according to claim 5, wherein a dimension of the seed layer in the height direction is less than half of a dimension of the skirt portion in the height direction.

7. The inductor component according to claim 1, further comprising:

a resin layer provided inside the element body and surrounded by the element body, wherein the distal end of the skirt portion is in surface contact with the resin layer.

8. The inductor component according to claim 7, wherein the resin layer is a non-magnetic material.

9. The inductor component according to claim 8, wherein the resin layer contains fluorine.

10. The inductor component according to claim 9, wherein the resin layer contains a trifluoromethyl group.

11. The inductor component according to claim 9, wherein in the resin layer, a content rate of fluorine in a portion close to the inductor wiring is higher than a content rate of fluorine in a portion away from the inductor wiring.

12. The inductor component according to claim 7, wherein the resin layer contains silicon.

13. The inductor component according to claim 12, wherein the resin layer contains silsesquioxane.

14. The inductor component according to claim 7, wherein a dimension of the resin layer in the height direction is from 5 μm to 30 μm.

15. The inductor component according to claim 1, wherein a dimension in the height direction of the element body is equal to or less than 500 μm.

16. The inductor component according to claim 1, wherein the inductor wiring contains sulfur from 0.01 atomic % to 1 atomic %.

17. The inductor component according to claim 2, wherein in a case where in a transverse plane of the inductor wiring that is orthogonal to a direction in which the inductor wiring extends, a largest dimension among dimensions in the height direction is defined as a maximum dimension, a ratio of the maximum dimension to a dimension in the width direction of the distal end of the skirt portion is equal to or less than 0.89.

18. The inductor component according to claim 2, wherein in a case where in a transverse plane of the inductor wiring that is orthogonal to a direction in which the inductor wiring extends, a largest dimension among dimensions in the height direction is defined as a maximum dimension, a ratio of the maximum dimension to a dimension in the width direction of the distal end of the skirt portion is equal to or less than 0.86.

* * * * *